US005378040A

United States Patent [19]

Chaney et al.

[11] Patent Number: 5,378,040

[45] Date of Patent: Jan. 3, 1995

[54] ADJUSTABLE GERIATRIC CHAIR

[75] Inventors: David B. Chaney, Powell, Ohio; Rex K. Chaney, Hartford City, Ind.; Joseph A. Koncelik, Powell, Ohio

[73] Assignee: Zoetech, Inc., Westerville, Ohio

[21] Appl. No.: 7,485

[22] Filed: Jan. 22, 1993

[51] Int. Cl.[6] ..... A47C 1/032; A47C 7/38

[52] U.S. Cl. ..... 297/338; 297/363; 297/452.56; 297/397

[58] Field of Search ..... 297/338, 363, 354.12, 297/440.2, 440.22, 440.23, 353, 337, 452.56, 411.45, 397

[56] References Cited

U.S. PATENT DOCUMENTS

| | | | |
|---|---|---|---|
| 96,737 | 11/1869 | Smith | 297/411.45 |
| 590,045 | 9/1897 | Mauchain | 297/353 X |
| 2,450,654 | 10/1948 | Gleitsman et al. | 297/354.12 |
| 3,137,527 | 6/1964 | Hoven et al. | 297/411.45 |
| 3,154,345 | 10/1964 | Lambrecht | 297/352.56 X |
| 3,233,942 | 2/1966 | Creutz | 297/440.23 X |
| 3,945,651 | 3/1976 | Boswinkel | 297/337 |
| 4,440,443 | 4/1984 | Nordskog | 297/397 |
| 4,529,246 | 7/1985 | Leib | 297/285 |
| 4,682,816 | 7/1987 | Massonnet | 297/359 |
| 4,818,021 | 4/1989 | Roysher | 297/440 |
| 4,930,842 | 6/1990 | Wilkinson et al. | 297/466 |
| 5,080,438 | 1/1992 | Moyer | 297/440.23 |

FOREIGN PATENT DOCUMENTS

| | | | |
|---|---|---|---|
| 56070 | 7/1982 | European Pat. Off. | 297/354.12 |
| 1120495 | 7/1956 | France | 297/440.23 |
| 1216598 | 4/1960 | France | 297/440.23 |
| 567141 | 12/1932 | Germany | 297/363 |
| 2813743 | 10/1979 | Germany | 297/440.23 |
| 1186394 | 4/1970 | United Kingdom | 297/452.56 |
| 2095104 | 9/1982 | United Kingdom | 297/352.12 |

*Primary Examiner*—Kenneth J. Dorner
*Assistant Examiner*—David E. Allred
*Attorney, Agent, or Firm*—Porter, Wright, Morris & Arthur

[57] ABSTRACT

An adjustable geriatric chair comprising a pair of laterally spaced apart floor-engaging upright frames; brackets associated with each of the frames and provided with a plurality of mounting bores including an upper rear set, a lower rear set and a front set; a back frame; and a seat frame. The back frame and seat frame, each having a pair of laterally opposing longitudinally extending sides, are movably disposed within the upright frames to align a pair of mounting sockets on each side of the back frame with a selected pair of bores in the upper rear set of bores and a front and a rear mounting socket on each side of the seat frame with a selected bore in each of the front and lower rear sets of bores, and are mounted to the brackets by mounting members inserted through the selected bores and extending into the mounting sockets. Webbing is mounted on the seat frame, such that the seat suspends the pelvis of the user without bottoming against a hard surface, and on the back frame.

16 Claims, 5 Drawing Sheets

ADJUSTABLE GERIATRIC CHAIR

BACKGROUND OF THE INVENTION

The present invention is concerned generally with orthopedic chairs and, more particularly, with those intended for use in hospitals, nursing homes and geriatric care centers.

Hospital patients, nursing home residents and particularly non-ambulatory geriatric patients may spend many consecutive hours in seated positions. When such a person is seated in a conventional padded chair for prolonged periods of time, pressure exerted on the tissues adjacent the ischial tuberosities on the base of the hip bone may lead to breakdown of these tissues, resulting in the formation of decubitus ulcers.

Existing chairs generally have a padded seating unit disposed over a hard surface. The seating unit of these chairs tends to "bottom out" over a period of time against the hard surface in response to the weight of the chair user, thereby exerting pressure on the tissues adjacent the ischial tuberosities. The hips of a person seated in a conventional hospital chair also tend to tilt anteriorly, exerting shear on the tissues adjacent the ischial tuberosities. The pressure and shear exerted on these tissues during prolonged seating cause discomfort to the user and contribute to the formation of decubitus ulcers.

The preferred seating position of infirm persons may vary with individual physical characteristics and desires. For example, the seat height of a hospital or geriatric chair should allow an ambulatory user to attain a seated position without an abrupt drop, to rest his or her feet on the ground while in a seated position, and to rise from a seated to a standing position with a minimum of difficulty. A person using a chair with too high a seat is likely to experience discomfort and difficulty in rising to a standing position because his lower legs and feet are dangling from the forward edge of the seat rather than resting on the ground. Similarly, a person using a chair with too low a seat is likely to experience difficulty in lowering his body to a seated position without an abrupt drop and in rising to a standing position. Hence, a short person may require a lower seat height than a tall person and vice versa. In addition, male users generally prefer a more reclined seat back angle than female users.

Existing hospital or geriatric chairs are either static, i.e., formed with fixed seating positions, or are equipped with relatively expensive mechanical devices for adjusting seat and/or back positions. The relatively inexpensive conventional static chairs have limited utility since they cannot be adjusted to the seating preferences or needs of a particular user nor readjusted to suit a subsequent user. For example, a "hip chair" seating position, in which the front of the seat is inclined downward relative to the back of the seat, is often recommended for people afflicted with certain hip problems to assist in maintaining the hip joint in the proper position. Existing orthopedic chairs generally provide seating positions in which the front of the seat is even with or inclined upward relative to the back of the seat. Such chairs are not adapted to provide a "hip chair" adjustment without resort to improvisation with cushions or other support means which may shift out of position in response to a user's movements. Hence, use of existing hospital chairs by persons for whom a hip chair is recommended may cause discomfort, or perhaps even exacerbate the hip condition or delay post-surgical recovery.

Infirm persons may experience a loss of muscle strength, particularly in the upper thighs, making it difficult to rise from a seated position to a standing position. Infirm persons also may experience difficulties in visually perceiving the spatial relationship between an object and the position of his body, making it difficult for such a person to align himself in the proper position for seating himself in a chair. Such persons tend to rely on chair arms to provide leverage in rising from a seated position to a standing position, and to assist in locating the chair position prior to and while being seated. The arms of existing geriatric chairs generally do not extend as far as the forward edge of the seat, thereby diminishing their ability to assist an infirm user in reaching seated or standing positions.

Infirm persons who remain seated in geriatric chairs for prolonged periods commonly rest their elbows upon armrests provided on such chairs. The armrests of existing chairs often tend to "trap" the ulnar or radial nerves located near the user's elbow, resulting in numbness and loss of strength of the user's hands.

Infirm persons may experience conditions such as incontinence, seepage from wounds, or other discharges of bodily fluids which necessitate cleaning and disinfection of their chairs. Existing geriatric chairs generally are not constructed to permit disassembly for thorough cleaning and disinfection of all chair surfaces, and therefore may harbor microbial growth and unpleasant odors.

Infirm persons who suffer from dementia may tend to pick at surfaces conveniently within their reach, such as the side panels of the chairs in which they are seated, eventually causing damage to these surfaces. Existing geriatric chairs generally are not constructed to permit ready replacement of damaged components thereof, so damaged chairs must either be discarded or sent out for relatively expensive repairs.

It is believed that geriatric or hospital chairs having a fashionable appearance improve the self-image and morale of infirm persons, promote the voluntary use of such chairs, and tend to increase the social interaction of a person seated therein. Unfortunately, existing chairs for use by infirm persons generally have an institutional appearance.

Accordingly, the present inventors were faced with the problem of devising a hospital or geriatric chair which overcomes the foregoing drawbacks of conventional chairs of this type.

SUMMARY AND OBJECTS OF THE INVENTION

An adjustable geriatric chair according to the present invention basically comprises a pair of laterally spaced apart floor-engaging upright frames, each of which defines a side enclosure; brackets disposed within the side enclosure of each of the upright frames and provided with a plurality of mounting bores including an upper rear set, a lower rear set and a front set; a back frame having a pair of laterally opposing longitudinally extending sides, each of the sides having a pair of mounting sockets; a seat frame having a pair of laterally opposing, longitudinally extending sides, each of the sides having a front and a rear mounting socket; a plurality of mounting members; webbing adapted to be mounted on the seat frame and the back frame; and cushioning adapted to be removably mounted on the seat frame and the back frame. The back frame is movable to align the mounting sockets with a selected pair of bores in the upper rear set of mounting bores on each of the upright frames. The seat frame is movable to align the front and rear mounting sockets with a selected bore on each of the front and lower rear sets, respectively, of the mounting bores on each of the upright frames. The mounting members are adapted to extend through the selected bores in the upper rear, lower rear and front sets of mounting bores on each of the upright frames and to extend into the mounting sockets disposed on each side of the back frame and the seat frame.

A primary object of the present invention is to provide an adjustable chair for use by infirm persons. The seat portion of the present geriatric chair provides means for suspending the pelvis of the user without bottoming against a hard surface, thereby enhancing comfort and preventing or reducing the formation of decubitus ulcers. The seat contour is believed to assist in maintaining a desired posterior tilt to the user's pelvis, further enhancing comfort and preventing or reducing decubitus ulcer formation. The present geriatric chair also provides relatively inexpensive means for adjusting the relative heights and angles of the back and the seat to adapt to the changing needs or preferences of a single user or a succession of users, as well as to provide therapeutic positioning for the user. The present invention also provides removable cushioning for the back and seat and removable side panels to simplify cleaning and replacement of worn components. These and other objects and advantages of the present geriatric chair may be more readily perceived or understood in view of the following drawings and detailed description.

DESCRIPTION OF PREFERRED EMBODIMENT

Figure 1:
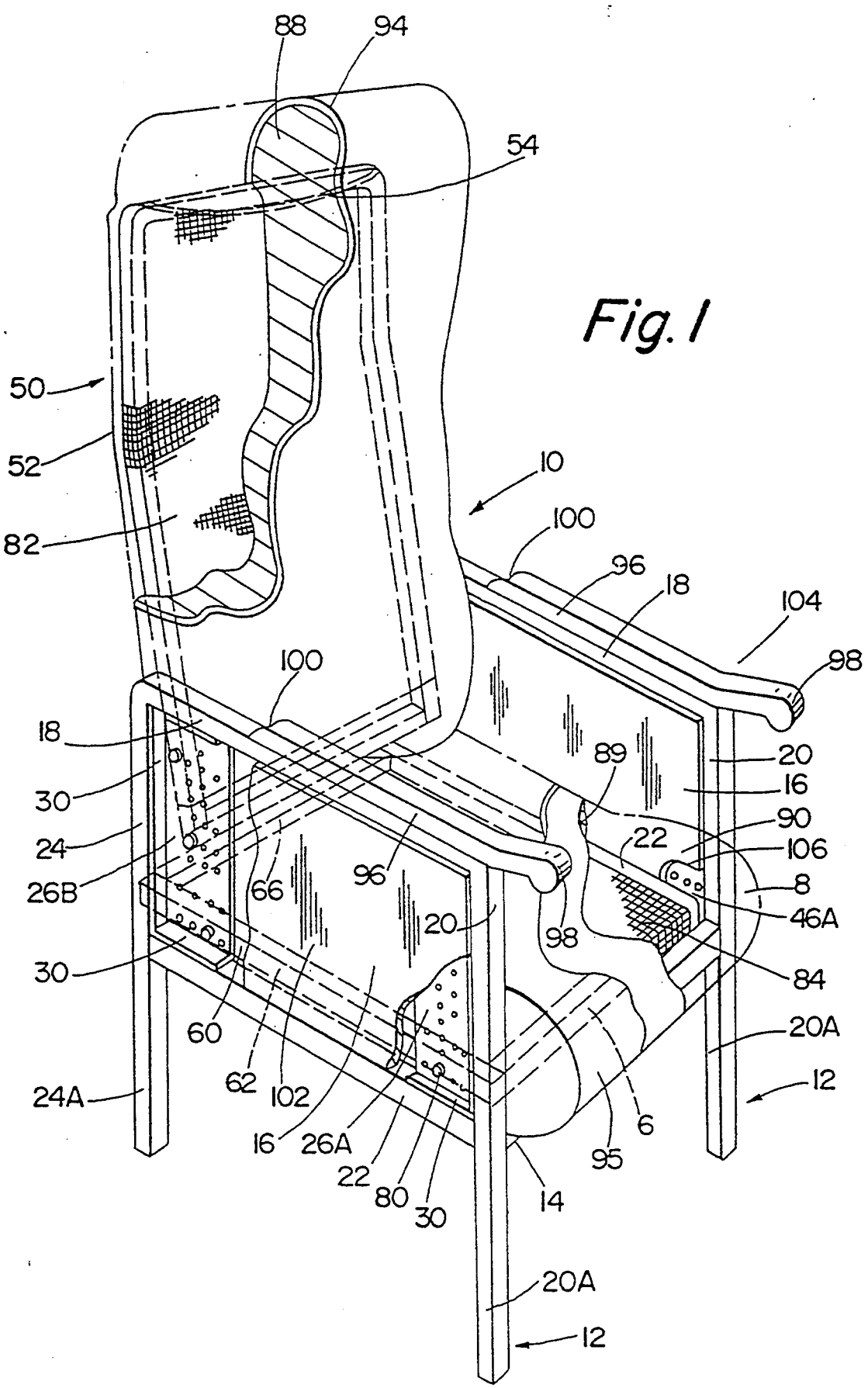
FIG. 1 is a perspective view of a geriatric chair according to the present invention, with portions of the cushioning material on the back and seat and one side panel broken away to illustrate underlying structures.
Figure 3:
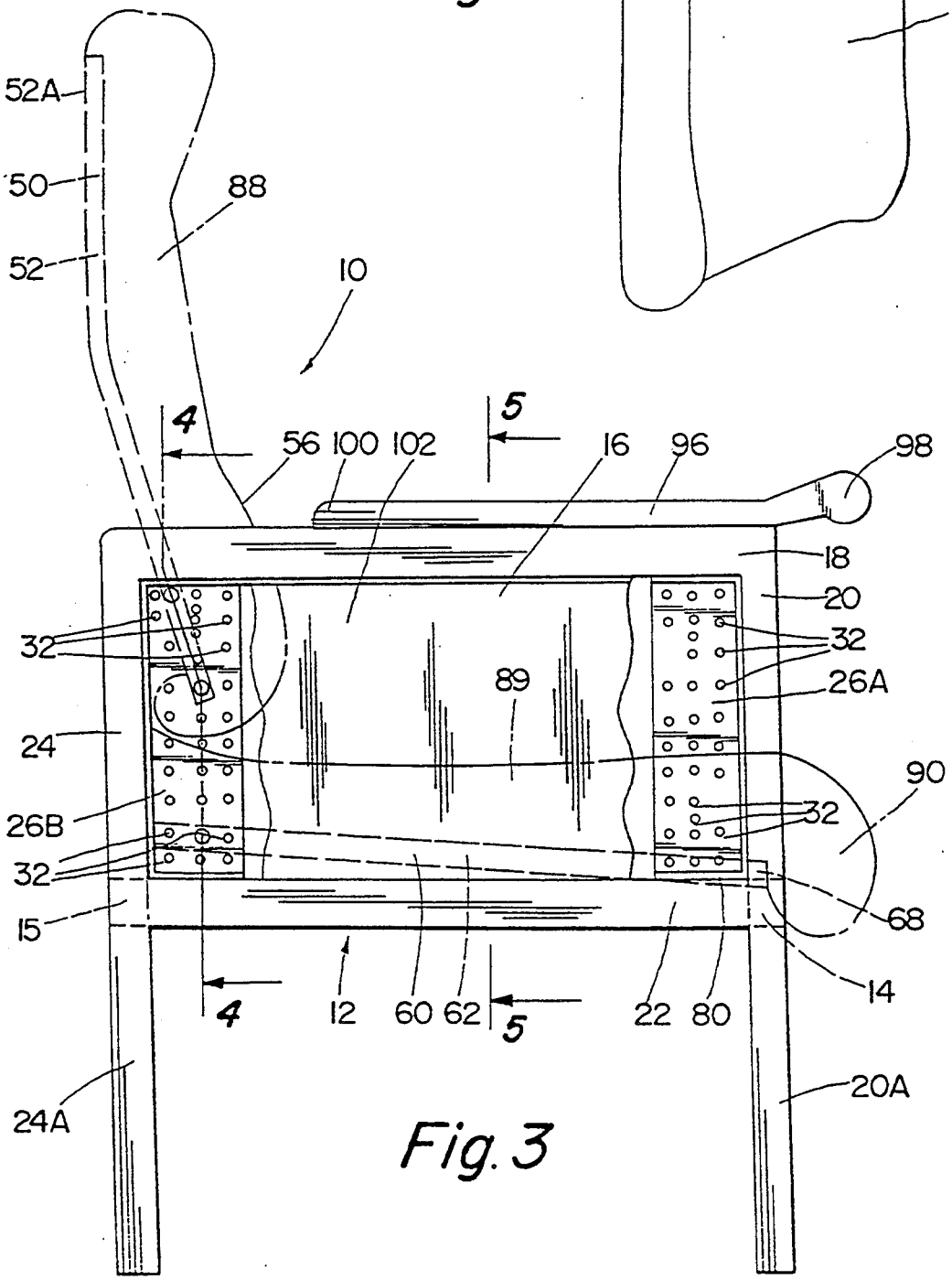
FIG. 3 is a side elevational view of one of the floor-engaging, upright frames of the present chair with portions of the exterior side panel broken away to illustrate the mounting brackets for the back and seat.

As shown in FIGS. 1 and 3, the adjustable geriatric chair generally designated 10 according to the present invention is provided with a pair of laterally spaced apart floor-engaging upright frames generally designated 12. Each of the upright frames 12 defines a side enclosure 16 therein which is bounded by relatively adjoining upper 18, front 20, lower 22 and tear 24 support members. Each of the generally vertically disposed front and rear support members 20, 24 includes ground-engaging leg portions 20A and 24A, respectively. An armrest 96 is secured to the upper support member 18 on each of the upright frames 12. A front portion 98 of each armrest 96 projects forwardly of the front support member 20 and is contoured to provide a comfortable surface for gripping by the user. The front portion 98 is upwardly inclined, as shown in FIGS. 1 and 3, to provide a user with mechanical advantage when egressing the chair. A rear end 100 of each armrest 96 is spaced forwardly on the back of the chair so that there is space for the user's elbows therebetween. In this manner, the user is less likely to trap or pinch the ulnar or radial nerve against the armrest 96. A horizontally extending front transverse member 14 connects the front support members 20 of the spaced apart upright frames 12 together, and a horizontally extending rear transverse member 15 connects the rear support members 24 together. Preferably, the support members 18–24, transverse members 14, 15 and armrests 96 are formed from wood. Aluminum alloy, steel or synthetic resin material are contemplated alternatives.

As further indicated in FIGS. 1 and 3, a front bracket 26A is disposed in relatively adjoining relation to the upper 18, front 20 and lower 22 support members, and a rear bracket 26B is disposed in relatively adjoining relation to the upper 18, lower 22 and rear 24 support members of each upright frame 12. Each of the brackets 26A,B has mounting flanges 30 projecting generally perpendicularly to a generally planar face thereof for engaging the adjoining support members. Suitable fasteners 31 (FIG. 4) secure the mounting flanges 30 and adjoining support members together. Advantageously, the brackets 26A,B reinforce and bind together the support members to which they are secured, as well as serving a mounting function for the seat and back frames, as described below. Preferably, the brackets 26A,B are formed from steel or aluminum alloy Synthetic resin material may be a suitable alternative for the subject brackets. It is contemplated that each of the upright frames 12, including the support members 18–24 and the brackets 26A, B, could be molded and/or extruded from synthetic resin material, either separately or as a unitary structure.

Figures 7, 8:
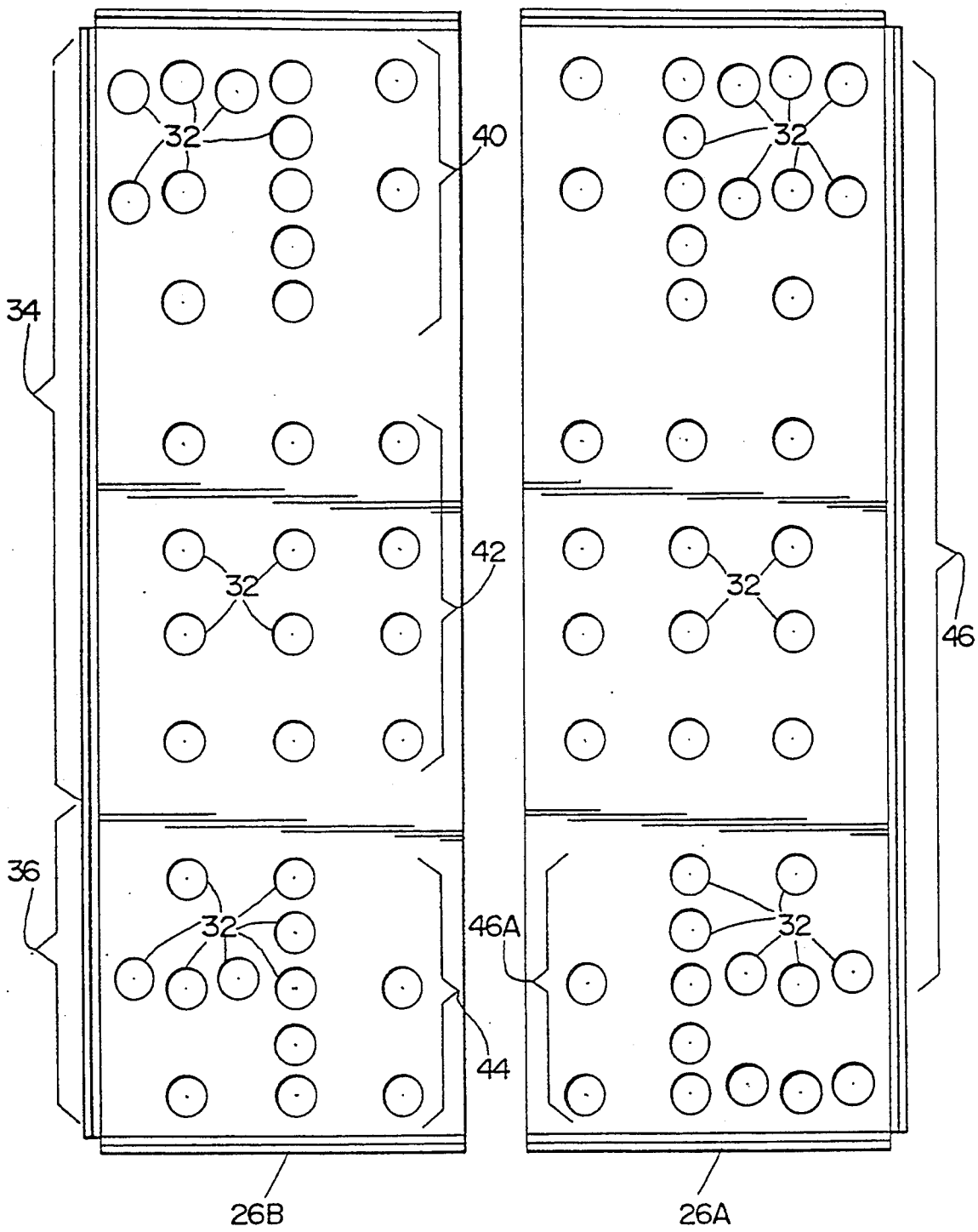
FIG. 7 is an enlarged front elevational view of a rear mounting bracket disposed on each of the upright frames.
FIG. 8 is an enlarged front elevational view of a front mounting bracket disposed on each of the upright frames.

FIGS. 7 and 8 show the planar faces of the front and rear brackets 26A,B. Each bracket face is provided with a plurality of mounting bores 32 extending therethrough. The mounting bores in the rear bracket 26B are divided into an upper rear set 34 and a lower rear set 36. The upper rear set 34 is arranged in a first pattern 40 and a second pattern 42. The lower rear set 36 defines a third pattern 44. The mounting bores in the front bracket 26A comprise a fourth pattern 46. Preferably, the fourth bore pattern 46 is the mirror image of the first, second, and third bore patterns 40–44 collectively. Alternatively, a fourth bore pattern 46A which is the mirror image of the third bore pattern 44 may be provided.

Figure 2:
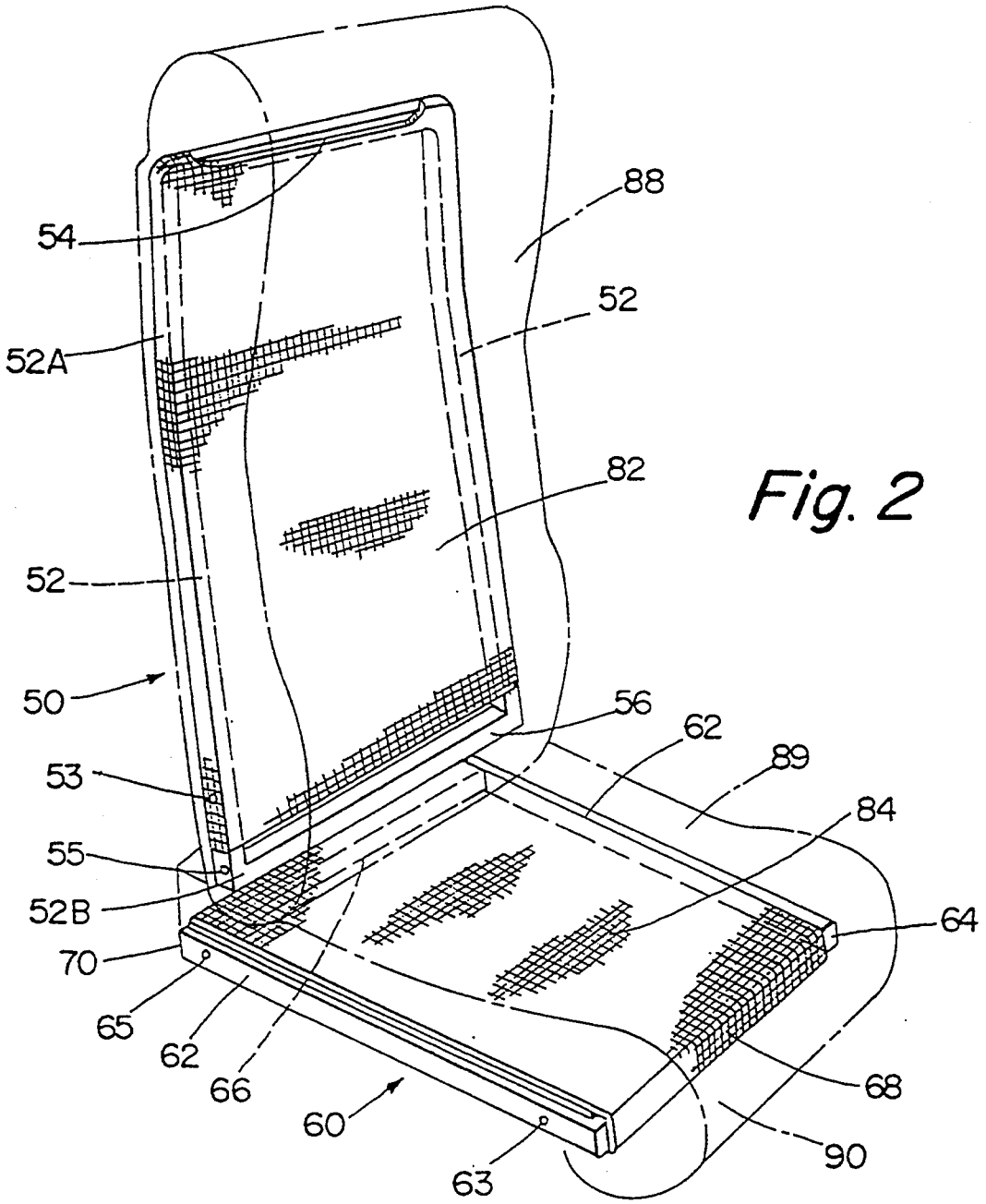
FIG. 2 is a perspective view of the frames and webbing for the seat and back portions of the present geriatric chair.

FIG. 2 shows a back frame generally designated 50 and a seat frame generally designated 60. The back frame 50 comprises a pair of laterally opposing, longitudinally extending side members 52 and transversely extending upper and lower support members 54, 56. As best indicated in FIG. 3, an upper portion 52A of each of the side support members 52 is canted slightly forwardly so that a headrest portion of the cushion, as described below, is suitably positioned.

The seat frame 60 is formed with a pair of laterally opposing, longitudinally extending side members 62 and with transversely extending front and rear support members 64, 66. Preferably, the transversely extending support members 54, 56 and 64, 66 on the back and seat frames are disposed at opposite ends of the adjoining side members 52 and 62, respectively, and no intermediate transverse members are provided therebetween. In this manner, the back and seat frames 50, 60 do not interfere with the movement of the webbing disposed thereon, as described in more detail below. The back and seat frames 50, 60 are formed from hollow form steel or aluminum alloy material; however, it is contemplated that wood or synthetic resin material also would suffice. The front and rear transverse members 64, 66 of the seat frame 60 and the upper and lower transverse members 54, 56 of the back frame 50 are generally equal in length. Accordingly, the seat frame 60 and the back frame 50 are generally equal in width. In this manner, the subject frames are properly received between the upright frame members 12 as described in further detail below.

As further indicated in FIG. 2, each of the side members 62 on the seat frame 60 is provided with a front mounting socket 63 and a rear mounting socket 65. The front mounting socket 63 is disposed generally adjacent to a front end 68 defined by the front transverse member 64 on the seat frame 60, and the rear mounting socket 65 is disposed generally adjacent to a rear end 70 defined by the rear transverse member 66 of the seat frame. The length of the side seat frame members 62 and the positions of the front and rear mounting sockets 63, 65 thereon are such that the front socket 63 may be aligned with any of the bores in the fourth pattern 46A (FIG. 8), whereupon the rear socket 66 is alignable with one or more bores in the third pattern 44 (FIG. 7) and vice versa.

Each of the side members 52 of the back frame 50 is provided with an upper mounting socket 53 and a lower mounting socket 55 disposed in spaced relation to one another well below a mid-line of the side member 52. The upper and lower mounting sockets 53, 55 are positioned so that the upper socket 53 may be aligned with any of the bores 32 in the first pattern 40 (FIG. 7) of the rear bracket, whereupon the lower socket 55 is alignable with one or more of the bores 32 in the second pattern 42 (FIG. 7) and vice versa.

Figure 4:
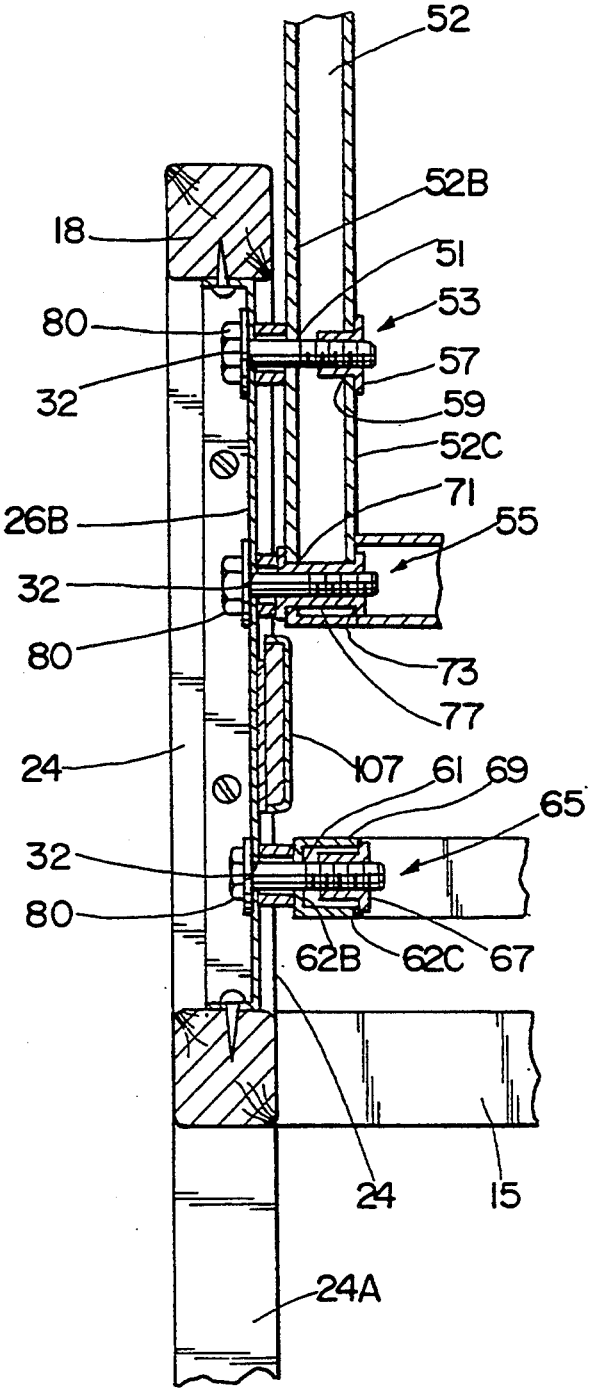
FIG. 4 is an enlarged vertical sectional view along line 4—4 of FIG. 3 and particularly illustrates the connections between the back and seat and one of the upright frames.

As indicated in FIG. 4, the upper socket 53 in each of the back frame side members 52 comprises a mounting member-receiving bore 51 extending through the exterior wall 52B of the side member and a threaded plug 57 aligned with the member-receiving bore 51 and mounted in a plug-receiving bore 59 in the interior wall 52C of the side member. The lower socket 55 in each of the back frame side members 52 comprises a pair of aligned, mounting member-receiving bores 71, 73 extending through the exterior and interior walls 52B,C of the side member and a threaded plug 77 mounted in the member-receiving bores.

As further indicated in FIG. 4, the rear mounting socket 65 in each of the seat frame side members 62 comprises a mounting member-receiving bore 61 extending through the exterior walls 62B of the side member and a threaded plug 67 aligned with the member receiving bore 61 and mounted in a bore 69 in the interior wall 62C of the side member. The front mounting socket 63 in each of the seat frame side members 62 is substantially identical in construction to the rear mounting socket 65.

As further indicated in FIG. 4, a plurality of bolts 80 serve as mounting members which extend through selected bores 32 in the rear bracket 26B and threadedly engage the upper and lower mounting sockets 53, 55 in the back frame side member 52 and the rear mounting socket 65 in a seat frame side member 62. A spacer 81 is disposed in surrounding relation to each bolt 80 and abuts at opposite ends against the rear bracket 26B and the exterior walls 52B,62B of the side frame members. In this manner the back and seat are prevented from abutting against the adjacent upright frame members 18,24. Likewise, a bolt 80 extends through the selected bore in the front bracket 26A and threadedly engages the front mounting socket 63. A spacer 81 is disposed between the front bracket 26A and the exterior wall of the side member 62 in surrounding relation to the bolt 80. A similar arrangement of bolts and spacers are provided between the upright frame 12 and the side members of the back and seat frames on the opposite side of the present chair.

As shown in FIGS. 1 and 2, a sleeve 82 of webbing material is tightly stretched over and extends between the side members 52 of the back frame 50, and another sleeve 84 of webbing material is tightly stretched over and extends between the front and rear transverse members 64,66 of the seat frame 60. The back sleeve 82 and seat sleeve 84 are formed from resilient rubber-impregnated fabric. The fabric is sufficiently strong to support the weight of the user without exceeding its elastic limit. Advantageously, since there are no intermediate frame members in the seat frame 60, the fabric web 84 does not bottom out against a frame member, thereby reducing the likelihood of decubitus ulcers.

As indicated in FIG. 1, a resilient overlay of cushioning material 88, such as polyurethane foam, is removably mounted on the back frame and sleeve 50,82 and another overlay of cushioning material 89 is removably mounted on the seat frame and sleeve 60,84. Preferably, the density of the seat cushion 89 is sufficient, in combination with the seat sleeve 84, to provide a maximum deflection of approximately 2 inches and a 50 percent compression at maximum deflection.

As indicated in FIGS. 2 and 3, the seat cushion 89 and back cushion 88 are contoured to provide greater resiliency and support in particular areas. The seat cushion 89 is thicker at the front and rear ends 68, 70 of the seat frame. It is believed that the resulting bowed profile of the seat cushion 89, known as "ramming," assists in maintaining a desired posterior tilt to the user's pelvis. In addition, the rear portion 70 of the seat cushion 89 extends almost to the lower end of the back cushion 88, thereby shielding the user's posterior from view. A rounded front overhanging portion 90 of the seat cushion 89 projects forwardly of the front end 68 of the seat frame. As indicated in FIG. 3, the back cushion 88 is thicker at its upper and lower ends than in the middle. The lower thickness is shaped and positioned to provide lumbar support and the upper thickness serves as a head rest.

As indicated in FIG. 1, a removable and fitted textile or vinyl fabric cover 94 secures the back cushion 88 to the back frame 50, and another removable and fitted cover 95 secures the seat cushion 89 to the seat frame 60. Preferably, the removable fabric coverings 94, 95 are secured to the back and seat frames by interlocking fabric tapes (not shown). In this manner, the removable cushions 88, 89 and covers 94, 95 are easily removed and reinstalled when cleaned or replaced.

Figure 6:
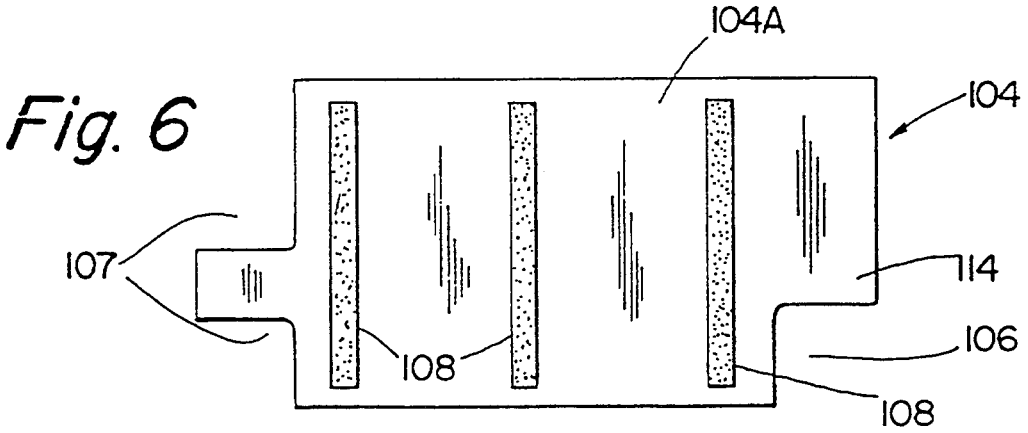
FIG. 6 is a side elevational view of the interior panel adapted for the side enclosures on the upright frames.
Figure 5:
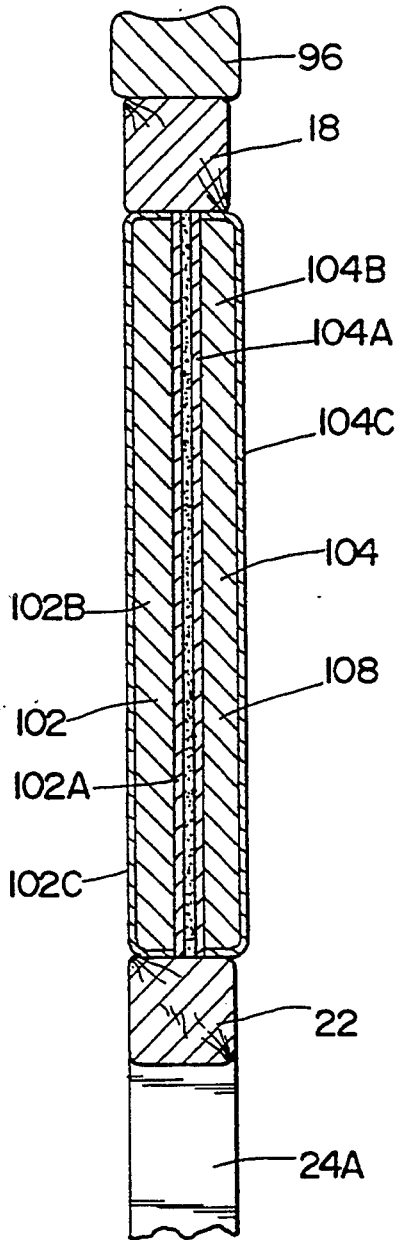
FIG. 5 is an enlarged vertical sectional view along line 5—5 of FIG. 3, and particularly illustrates the interior and exterior panels on the side enclosure of one of the upright frames.

As further illustrated in FIG. 1, outer and inner panels 102, 104 are adapted to be removably mounted on each of the upright frames 12 in substantially covering relation to the side enclosures 16 thereof. The outer panel 102 conceals the front and rear mounting brackets 26A, B and the space disposed therebetween. The inner panel 104 covers the unused portion of the front bracket 26A and the space between the front and rear brackets. The inner panel 104 is formed with a front notched portion 106 corresponding to the location of the fourth bore pattern 46A on the front bracket, and with a tail portion 107 (FIGS. 4,6) which is shaped and sized to extend between the second and third bore patterns on the rear mounting bracket. As indicated in FIGS. 5 and 6, the interior surfaces of the outer and inner panels 102, 104 are provided with fastening means, preferably strips of interlocking fabric tape 108. In this manner, the tape strips on one of the panels engage the tape strips on the other panel and thereby hold the panels in place on each of the upright frames 12. As indicated in FIG. 5, each of the panels 102, 104 is formed with a semi-rigid base 102A, 104A formed from tempered masonite or molded plastic, a cushion layer of polyurethane foam 102B, 104B and a fabric or vinyl cover 102C, 104C. Advantageously, the outer and/or inner panel may include a pocket (not shown) for storing personal items in a location convenient to the user.

Figure 9:
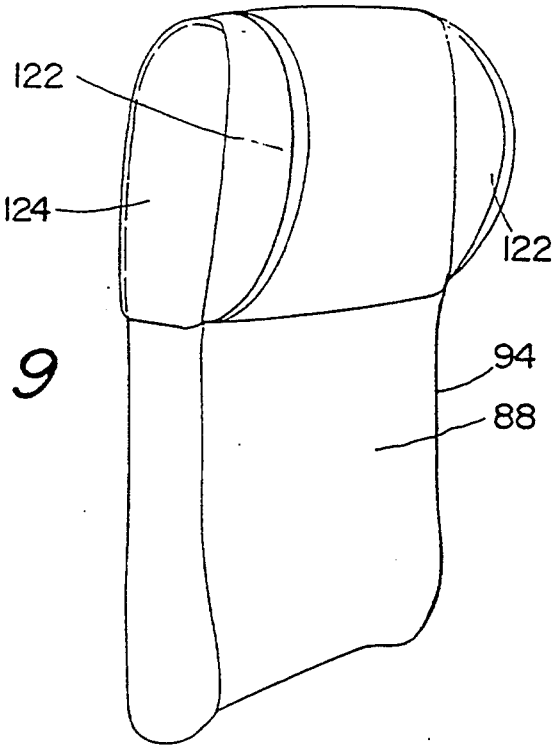
FIG. 9 is a perspective view of the back portion of the present chair provided with a wing sleeve mounted thereon.

As indicated in FIG. 9, the back portion 88 of the present chair is provided with a wing sleeve or cap 124 formed from cloth or vinyl material. The wing sleeve body 124 is sized to fit snugly over an upper portion of the back 88 and is closed at one end to limit downward movement. A pair of laterally spaced apart wings 122 project forwardly from opposite side of the cap 122. The wings 122 are formed of cushioning material and a fabric or vinyl cover. The wing sleeve may be positioned to conform substantially to the contour of the back 88 or it may be adjusted upwardly to accommodate the needs or preferences of different users by positioning resilient shim blocks (not shown) between the closed end of the cap 124 and the top of the back 88.

The seat and back positions of the present geriatric chair 10 are altered in the following manner. First, the outer panels 102 are removed from the upright frames. The bolts 80 are then backed out of the upper and lower mounting sockets 53,55 on each side of the back frame 50 and are withdrawn, together with the spacers 81, from the rear bracket 26B on each of the upright frames 12. The chair back is then shifted to align the lower mounting socket 55 with a selected mounting bore 32 in the second pattern 42 on each of the rear brackets 26B, whereupon mounting bolts 80 are inserted through the selected mounting bores 32, through spacers 81 and into the mounting sockets 55 on the side members 52 of the back frame. The back is then pivoted to align the upper sockets 53 on opposite sides of the back frame with selected bores in the first pattern 42 of the rear bracket on each of the upright frames. Bolts are then inserted through the selected bores and associated spacers and threaded into the upper sockets. All of the bolts securing the back to the upright frames are then tightened. Similarly, the seat height and seat angle may be adjusted by unscrewing the mounting bolts 80 in the front and rear sockets 63,65 on each side member 62 of the seat frame and by removing the subject bolts and associated spacers from the front and rear brackets 26A,B. The seat is then shifted to align the front mounting socket 63 on each side with a selected bore in the fourth pattern 46A on the front mounting bracket 26A on each of the upright frames. Bolts are then inserted through the selected bores and associated spacers and into the front mounting socket on each side of the seat frame. The seat is then pivoted to align the rear socket 65 with a selected bore in the third pattern 44 of the rear bracket 26B on each of the upright frames, and bolts are inserted through the selected bores and associated spacers and into the rear sockets. All of the bolts securing the seat frame to the upright frames are then tightened, thereby securing the seat in place. Finally, the outer panel 102 on each upright frame 12 is reattached to the associated inner panel 104.

Thus, it may be seen that the back and seat of the present geriatric chair are simply and independently adjustable to suit the changing needs of the user. In addition, the present geriatric chair is relatively inexpensive to manufacture, is designed to inhibit the formation of decubitis ulcers and is easily cleaned, repaired and/or reconditioned.

While a single preferred embodiment of the present invention has been illustrated and described in some detail, the foregoing specification is not intended to unduly limit the spirit or gist of the invention, nor to restrict the scope of the following claims.

We claim:

1. An adjustable chair comprising:

a) a pair of laterally spaced apart, floor-engaging upright frames, each defining a side enclosure bounded by relatively adjoining upper, front, lower, and rear support members;

b) a front bracket disposed in a relatively adjoining relation to the upper, lower and front support members and a rear bracket disposed in relatively adjoining relation to the upper, lower and rear support members, each bracket recessed within the side enclosure of each of the floor-engaging frames said rear bracket provided with an upper rear set and a lower rear set of mounting bores and said front bracket provided with a front set of mounting bores;

c) a back frame having a pair of laterally opposing, longitudinally extending side members, each of the side members having a pair of mounting sockets, said back frame being movable to align the mounting sockets with a selected pair of bores in the upper rear set of mounting bores on the rear brackets;

d) a seat frame having a pair of laterally opposing, longitudinally extending side members, each of the side members having a front mounting socket and a rear mounting socket, said seat frame being movable to align the front mounting socket and the rear mounting socket with a selected bore in each of the front set and lower rear set, respectively, of the mounting bores on each of the rear and front bracket;

e) a plurality of mounting members adapted to extend through the selected bores in the upper rear set, the lower rear set and the front set of mounting bores on each of the floor-engaging frames and to extend into the mounting sockets disposed on each side of the back frame and the seat frame;

f) webbing adapted to be mounted on the seat frame and the back frame; and g) cushioning adapted to be mounted on the seat frame and the back frame.

2. The adjustable chair according to claim 1, further comprising:

a panel adapted to be removably mounted on each of the upright frames in substantially covering relation to the side enclosures.

3. The adjustable chair according to claim 2, wherein the panel comprises an inner panel removably fastened to an outer panel.

4. The adjustable chair according to claim 1, wherein the webbing comprises a pair of resilient mesh sleeves, one of said sleeves being mounted on and extending between the longitudinally extending sides of the back frame, the other of said sleeves being mounted on and extending between a front support member and a real support member on the seat frame.

5. The adjustable chair according to claim 1, wherein the selected bore in the lower rear set of mounting bores is higher than the selected bore in the front set of mounting bores on each of the brackets of each floor engaging upright frame.

6. The adjustable chair according to claim 1, wherein the mounting sockets on the back frame and the seat frame are threaded and wherein the mounting members are adapted to threadedly engage the mounting sockets and to releasably hold the back frame and the seat frame in selected positions relative to the floor-engaging frames.

7. The adjustable chair according to claim 1, wherein each of the longitudinally extending side members of the seat frame is provided with relatively opposing front and rear ends and wherein the front mounting socket on each of said longitudinally extending side members is disposed generally adjacent to said front end and the rear mounting socket is disposed generally adjacent to said rear end.

8. The adjustable chair according to claim 1, wherein an arm rest is mounted on the upper support member of each of the floor-engaging frames and is provided with a relatively elevated front portion.

9. The adjustable chair according to claim 8, wherein the elevated front portion of the arm rest and a front portion of the cushion means mounted on the seat frame project forwardly of the front support member on each of the floor-engaging frames.

10. The adjustable chair according to claim 1, wherein the upper rear set of mounting bores is arranged in first and second patterns on the rear bracket and wherein the lower rear set of mounting bores is arranged in a third pattern on the rear bracket below the first and second patterns.

11. The adjustable chair according to claim 1, wherein the front set of mounting bores is arranged in a fourth pattern on the front bracket.

12. The adjustable chair according to claim 1, wherein the first pattern of mounting bores is disposed above the second pattern of mounting bores and wherein the pair of mounting sockets on each side of the back frame are disposed so that the selected pair of bores in the upper rear set of mounting bores on each of the rear brackets includes a mounting bore in said first pattern and a mounting bore in said second pattern.

13. The adjustable chair according to claim 1, wherein a cap is adapted to be removably mounted on an upper portion of the back frame, said cap having a pair of laterally spaced apart, forwardly projecting wings.

14. An adjustable chair comprising:

a) a pair of laterally spaced apart, floor-engaging upright frames, each defining a side enclosure bounded by relatively adjoining upper, front, lower, and rear support members;

b) a front mounting bracket disposed in a relatively adjoining relation to the upper, lower and front support members and a rear mounting bracket disposed in relatively adjoining relation to the upper, lower and rear support members, each bracket recessed within the side enclosure of each of the floor-engaging frames and provided with a plurality of mounting bores;

c) a back frame having a pair of laterally opposing, longitudinally extending side members, each of the side members having a pair of mounting sockets, said back frame being movable to align the mounting sockets with a selected pair of bores in an upper rear portion of each of the rear mounting brackets; and d) a seat frame having a pair of laterally opposing, longitudinally extending side members, each of the side members having a front mounting socket and a rear mounting socket, said seat frame being movable to align the front mounting socket with a selected mounting bore in each of the front mounting brackets and to align the rear mounting socket with a selected bore in a lower rear portion of each of the rear mounting brackets.

15. An adjustable chair comprising:

a) a pair of laterally spaced apart floor-engaging upright frames having a relatively smooth finish, each of the floor-engaging frames defining a side enclosure bounded by relatively adjoining upper, front, lower, and rear support members, each of the a front mounting bracket disposed in a relatively adjoining relation to the upper, lower and front support members and a rear mounting bracket disposed in relatively adjoining relation to the upper, lower and rear support members, each bracket defining a plurality of mounting bores recessed from the left and right faces of each of the floor-engaging frames;

b) a back frame having a pair of laterally opposing, longitudinally extending side members, each of the side members having a pair of mounting sockets, said back frame being movable to align the mounting sockets with a selected pair of bores in an upper rear portion of each of the rear brackets; and c) a seat frame having a pair of laterally opposing, longitudinally extending side members, each of the side members having a front mounting socket and a rear mounting socket, said seat frame being movable to align the front mounting socket with a selected mounting bore in each of the front brackets and to align the rear mounting socket with a selected bore in a lower rear portion of each of the rear bracket.

16. The adjustable chair according to claim 15, further comprising:

a panel adapted to be removably mounted on each of the upright frames in substantially covering relation to the side enclosures;

a pair of resilient mesh sleeves, one of said sleeves being mounted on the back frame and the other of said sleeves being mounted on the seat frame;

an arm rest mounted on an upper portion of each of the floor-engaging frames and provided with a relatively elevated front portion that projects forwardly of the front portion of each of the floor-engaging frames; and a cap adapted to be removably mounted on an upper portion of the back frame and having a pair of laterally spaced apart, forwardly projecting wings.

* * * * *